US006347878B1

(12) United States Patent
Shiao

(10) Patent No.: US 6,347,878 B1
(45) Date of Patent: Feb. 19, 2002

(54) FLASHLIGHT WITH AN ELECTRICAL CONDUCTOR UNIT FOR ELECTRICALLY CONNECTING A LAMP UNIT WITH A BATTERY

(76) Inventor: Wen-Chin Shiao, No. 10, Alley 1, Lane 551, Sec. 1, Wen-Shou Rd., Kuei-Shan Hsiang, Tao-Yuan Hsien (TW)

( * ) Notice: Subject to any disclaimer, the term of this patent is extended or adjusted under 35 U.S.C. 154(b) by 0 days.

(21) Appl. No.: 09/472,107

(22) Filed: Dec. 27, 1999

(51) Int. Cl.[7] ..... F21L 4/00
(52) U.S. Cl. ..... 362/157; 362/203; 362/206
(58) Field of Search ..... 362/157, 202, 362/203, 206

(56) References Cited

U.S. PATENT DOCUMENTS

| | | | | | |
|---|---|---|---|---|---|
| 4,187,532 | A | * | 2/1980 | Naffier | 362/186 |
| 4,323,879 | A | * | 4/1982 | Kelly | 340/134 |
| 5,461,552 | A | * | 10/1995 | Tillery | 362/188 |
| 5,752,764 | A | * | 5/1998 | Shiau | 362/206 |
| 5,997,165 | A | * | 12/1999 | Lehrer | 362/581 |

* cited by examiner

*Primary Examiner*—Sandra O'Shea
*Assistant Examiner*—John Anthony Ward
(74) *Attorney, Agent, or Firm*—Darby & Darby

(57) ABSTRACT

A flashlight includes a conductive barrel body having annular front and rear end portions spaced apart from each other in an axial direction, and a battery accommodating space extending in the axial direction between the front and rear end portions to accommodate a battery unit therein. A sleeve member is mounted co-axially on the front end portion of the barrel body. A lamp unit is disposed in the sleeve member, and includes a lamp seat and a light bulb mounted removably on the lamp seat. An electrical conductor unit is disposed in the sleeve member between the front end portion of the barrel body and the lamp unit. The conductor unit includes a conductive core member having a first end in electrical contact with the light bulb, and a second end to contact electrically a first electrode of the battery unit inside the battery accommodating space. A dielectric core holding block is formed with an axial core mounting hole, within which the core member is mounted. A tubular conductive coupling member has the core holding block received therein, and has a rear section in electrical contact with the front end portion of the barrel body, and a front section in electrical contact with the lamp seat, thereby connecting electrically the barrel body and the lamp seat.

7 Claims, 5 Drawing Sheets

FLASHLIGHT WITH AN ELECTRICAL CONDUCTOR UNIT FOR ELECTRICALLY CONNECTING A LAMP UNIT WITH A BATTERY

BACKGROUND OF THE INVENTION

1. Field of the Invention

The invention relates to a flashlight, more particularly to a flashlight that has an improved electrical conductor unit disposed between a conductive barrel body and a lamp unit so as to provide effective electrical connection therebetween.

2. Description of the Related Art

Referring to FIG. 1, a conventional flashlight is shown to include a conductive barrel body 1 with front and rear end portions 10,11, a light bulb assembly 2 mounted on the front end portion 10, and a switch device 3 mounted on the rear end portion 11.

As illustrated, the conductive barrel body 1 defines a battery accommodating space 100 that extends in the axial direction between the front and rear end portions 10,11 and that is adapted to accommodate a battery unit 12 therein.

The switch device 3 includes a rear sleeve member 31 mounted threadedly on the rear end portion 11 of the conductive barrel body 1, and a push unit 33 with a dielectric outer sheath disposed inside the rear sleeve member 31. A biasing member 333 establishes connection between a first end of the push unit 33 and an electrode of the battery unit 12. The push unit 33 has a conductive radial outward projection 331 normally spaced apart from an end face 13 of the rear end portion 11 of the barrel body 1 in the axial direction, and a second end 335 that extends outwardly of the rear sleeve member 31 in the axial direction.

The light bulb assembly 2 includes a front sleeve member 21 sleeved threadedly on the front end portion 10 of the barrel body 1, a light bulb seat 23 disposed inside the front sleeve member 21, a reflector cap 25 mounted threadedly on the front sleeve member 21, and a light reflector 235 disposed inside the reflector cap 25 and in electrical contact with the barrel body 1. A biasing member 233 is disposed between the light reflector 235 and the light bulb seat 23, thereby biasing the light bulb seat 23 to contact electrically with another electrode of the battery unit 12 via a coil spring 237. Under such a condition, inward pressing action of the second end 335 of the push unit 33 relative to the rear sleeve member 31 will result in contact between the conductive outward projection 331 and the end face 13 of the rear end portion 11 of the barrel body 1, thereby establishing an electrical connection between the light bulb 236 and the battery unit 12. The reflector cap 25 can be moved relative to the front sleeve member 21 in order to achieve a variable focusing effect. The conductive barrel body 1 is further formed with a radial outward contact 14 adjacent to the front end portion 10 thereof. As such, in case the battery unit 12 is of a rechargeable type, the conventional flashlight can be disposed in the battery charging device 4 (see FIG. 2) so that clamping of the battery unit 12 can commence via the push unit 33 and the contact 14 of the flashlight, and charging terminals 41,43 on the battery charging device 4.

Some of the disadvantages of the aforesaid conventional flashlight are as follows:

(i) Movement of the reflector cap 25 relative to the front sleeve member 21 when varying the focusing effect may result in displacement of the light bulb seat 23, which in turn, affects proper electrical connection between the light bulb 236 and the battery unit 12. In addition, the biasing member 233 may suffer from spring fatigue after long term use, thus leading to eventual poor electrical connection between the light bulb 236 and the battery unit 12.

(ii) The light bulb 236 employed in the aforesaid conventional flashlight is generally a Krypton lamp and requires an electric current flow that is twice the current requirement of an ordinary light bulb. The large current flow can cause the coil spring 237 to melt, and can result in damage to the light reflector 235.

SUMMARY OF THE INVENTION

The object of this invention is to provide a flashlight which is clear of the disadvantages mentioned beforehand.

Accordingly, a flashlight of this invention includes a conductive barrel body, a sleeve member, a lamp unit, and an electrical conductor unit. The conductive barrel body has annular front and rear end portions spaced apart from each other in an axial direction, and a battery accommodating space that extends in the axial direction between the front and rear end portions and that is adapted to accommodate a battery unit therein. The sleeve member is mounted co-axially on the front end portion of the barrel body. The lamp unit is disposed in the sleeve member, and includes a lamp seat and a light bulb mounted removably on the lamp seat. The electrical conductor unit is disposed in the sleeve member between the front end portion of the barrel body and the lamp unit. The conductor unit includes a conductive core member having a first end in electrical contact with the light bulb, and a second end to contact electrically a first electrode of the battery unit inside the battery accommodating space. A dielectric core holding block is formed with an axial core mounting hole. The core member is mounted in the core mounting hole of the core holding block. A tubular conductive coupling member has the core holding block received therein, and has a rear section in electrical contact with the front end portion of the barrel body, and a front section in electrical contact with the lamp seat, thereby connecting electrically the barrel body and the lamp seat.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
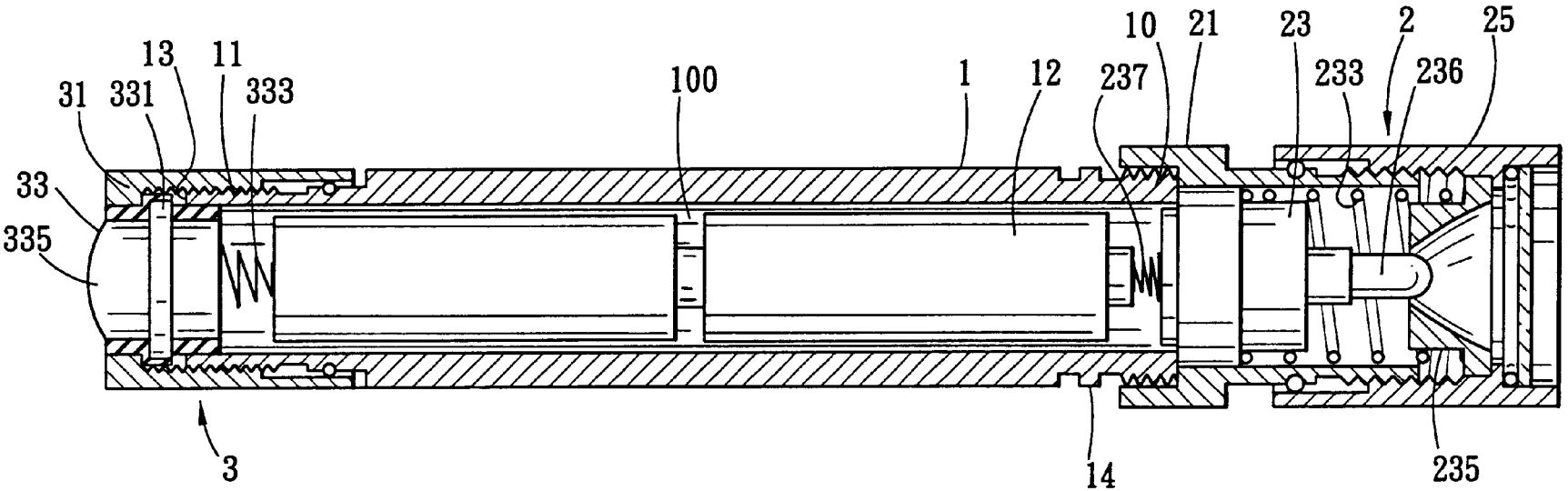
FIG. 1 PRIOR ART
FIG. 1 is a sectional view of a conventional flashlight.

Referring to FIGS. 3, 4, 5 and 6, the preferred embodiment of a flashlight of this invention is shown to include a conductive barrel body 5, a conductive front sleeve member 81, a lamp unit 82, and an electrical conductor unit 83.

As illustrated, the conductive barrel body 5 has annular front and rear end portions 57,59 spaced apart from each other in an axial direction, and a battery accommodating space 50 that extends in the axial direction between the front and rear end portions 57,59 that is adapted to accommodate a battery unit 52 therein. Preferably, the barrel body 5 has a roughened outer wall surface 56 between the front and rear end portions 57,59 to facilitate handling thereof.

The sleeve member 81 is mounted co-axially and threadedly on the front end portion 57 of the barrel body 5.

The lamp unit 82 is disposed in the sleeve member 81, and includes a conductive lamp seat 824 and a light bulb 821 mounted removably on the lamp seat 824.

The conductor unit 83 is disposed in the sleeve member 81 between the front end portion 57 of the barrel body 5 and the lamp unit 82. The conductor unit 83 includes a conductive core member 831, a dielectric core holding block 833, and a tubular conductive coupling member 835. The conductive core member 831 has a first end 8311 in electrical contact with the light bulb 821, and a second end 8312 that is adapted to contact electrically a first electrode of the battery unit 52 inside the battery accommodating space 50. The dielectric core holding block 833 is formed with an axial core mounting hole 8330. The core member 831 is mounted in the core mounting hole 8330 of the core holding block 833. The tubular conductive coupling member 835 has the core holding block 833 received therein, a rear section 8352 in electrical contact with the front end portion 57 of the barrel body 5, and a front section 8351 in electrical contact with the lamp seat 821, thereby connecting electrically the barrel body 5 and the lamp seat 821. Preferably, the front section 8351 of the conductive coupling member 835 is connected threadedly to the lamp seat 821.

Figure 2:
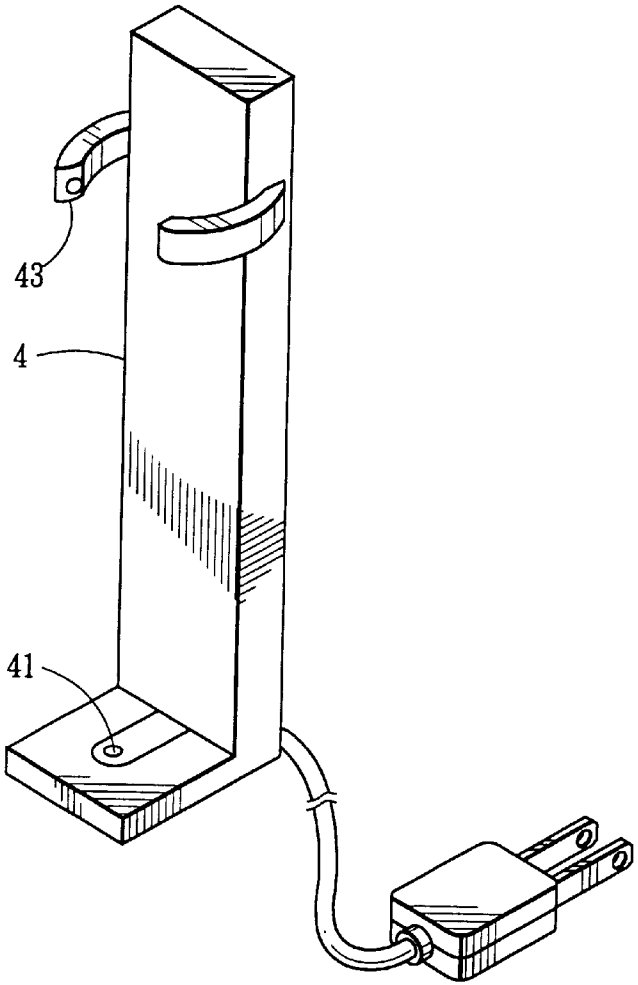
FIG. 2 PRIOR ART
FIG. 2 illustrates a battery charging device for charging the conventional flashlight shown in FIG. 1.
Figure 3:
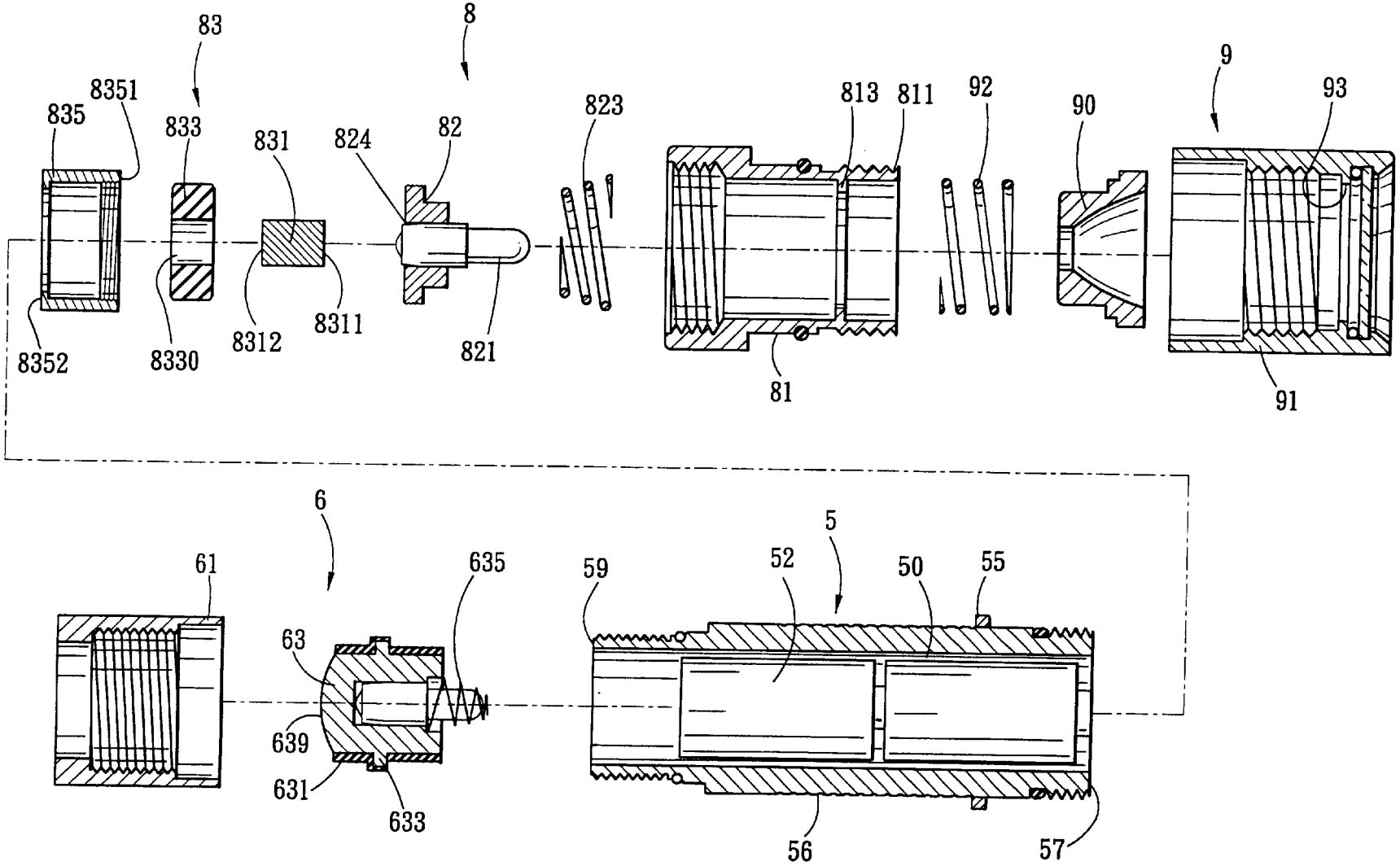
FIG. 3 is an exploded view of the preferred embodiment of this invention.
Figure 4:
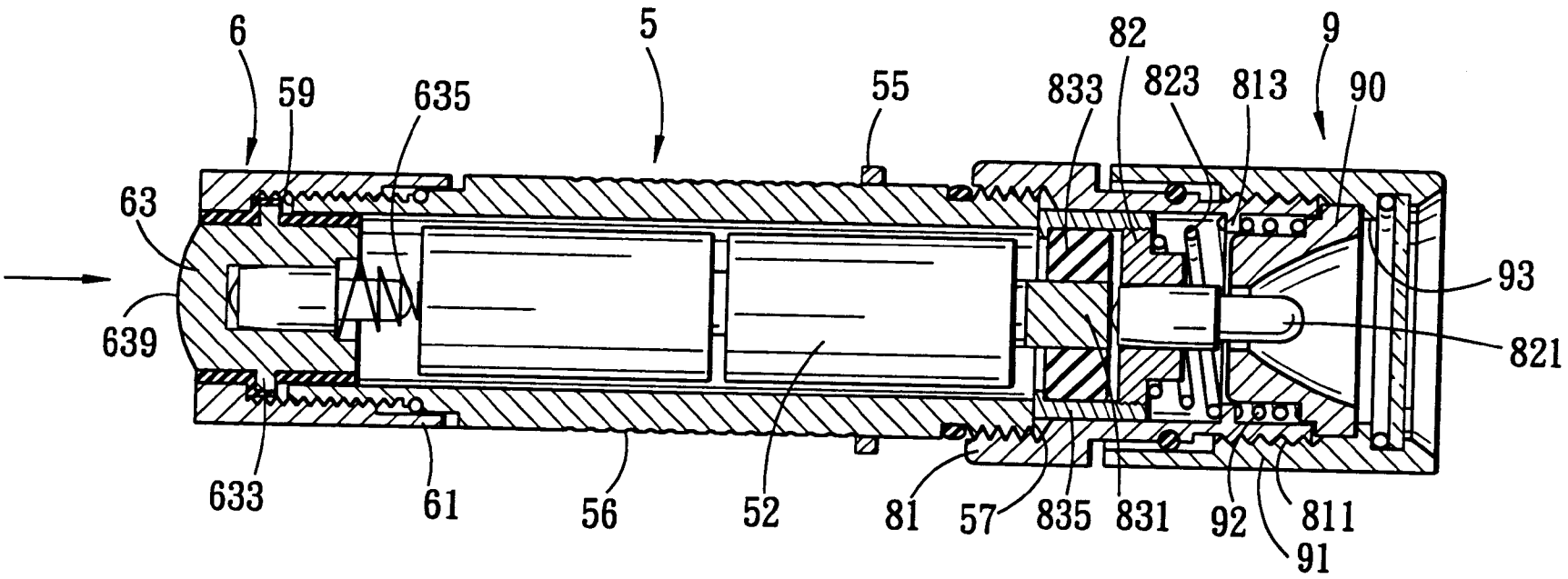
FIG. 4 is a sectional view of the preferred embodiment.
Figure 6:
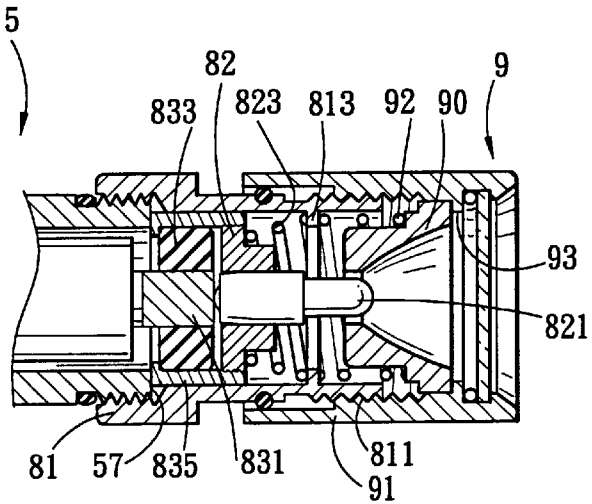
FIG. 6 is a fragmentary view of the preferred embodiment, illustrating how a light reflector is adjusted in order to achieve a variable focusing effect.
Figure 5:
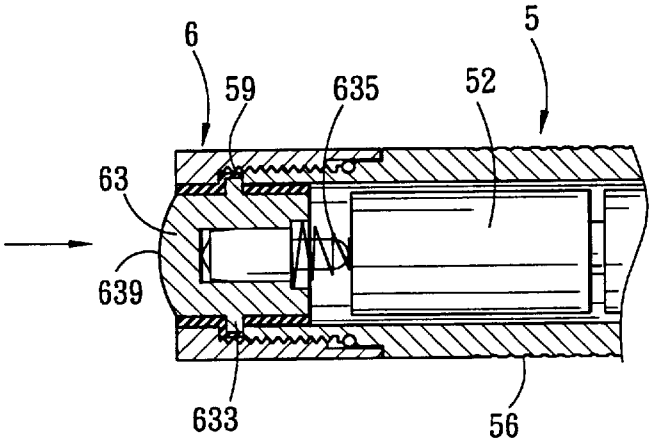
FIG. 5 is a fragmentary view of the preferred embodiment, illustrating how a switch device is actuated in order to establish electrical connection between a battery unit and a light bulb.

A switch device 6 includes a conductive rear sleeve member 61 threadedly mounted on the rear end portion 59 of the barrel body 5, a conductive push button 63 with a dielectric outer sheath 631 disposed in the rear sleeve member 61. A biasing member 635 establishes electrical connection between a first end of the push button 63 and a second electrode of the battery unit 52. The push button 63 has a second end 639 that projects outwardly of the rear sleeve member 61, and a conductive radial projection 633 normally spaced apart from an end face of the rear end portion 59 of the barrel body 5. The second end 639 of the push button 63 is adapted to be operated so as to make or break electrical connection between the rear end portion 59 of the barrel body 5 and the radial projection 633 of the push button 63, as best shown in FIG. 5. Preferably, the barrel body 5 is further formed with a radial outward contact 55 which cooperates with the second end 639 of the push button 63 for recharging the battery unit 52 on the battery charging device 4 of FIG. 2.

A reflector unit 9 is mounted co-axially on the front sleeve member 81, and includes a tubular reflector cap 91 sleeved on and engaging threadedly the external thread 811 of the sleeve member 81, alight reflector 90 disposed in the reflector cap 91, and a biasing member 92 for biasing the light reflector 90 in the axial direction away from the sleeve member 81 and toward a stop 93 formed in the reflector cap 91. The light reflector 90 is made of a heat resistant material, such as an aluminum alloy.

In the preferred embodiment, the conductive coupling member 835 is constructed to have an inner diameter larger than an outer diameter of the core holding block 833 so as to permit axial displacement of the core holding block 833 inside the conductive coupling member 835. The sleeve member 81 is formed with an inwardly projecting stop unit 813 therein. The lamp unit 82 further includes a biasing member 823 disposed between the lamp seat 824 and the stop unit 813. Preferably, the stop unit 813 is formed as an annular flange. The core member 831 has an axial length greater than that of the core mounting hole 8330 of the core holding block 833 such that the two ends 8311, 8312 of the core member 831 project out of the core mounting hole 8330. The core member 831 and the conductive coupling member 835 are made of a heat resistant material, such as copper, while the core holding block 833 is made of a heat resistant dielectric material, such as bakelite plastic. Alternatively, the core holding block 833 can be made of teflon resin or polycarbonate polymer.

The advantages provided by the flashlight of the present invention are as follows:

(i) The conductive core member 831 has two opposite ends projecting outwardly from two opposite ends of the dielectric core holding block 833 to ensure electrical connection between the battery unit 52 and the light bulb 823. In addition, slidable mounting of the core member 831 in the core holding block 833 will further ensure an effective electrical connection between the battery unit 52 and the light bulb 823.

(ii) The core member 831 can accommodate a relatively large current flow without damage thereo.

(iii) The conductor unit 83 and the light reflector 90 employed in the flashlight are more durable by virtue of its high heat-resistance properties, and the service life thereof are accordingly prolonged.

(iv) Replacement of the light bulb 821 can be conducted by simply removing the sleeve member 81.

(v) Adjustment of the light reflector cap 90 can be conducted without affecting the position of the lamp seat 824 in the sleeve member 81. In addition, removal of the light reflector cap 90 from the sleeve member 81 can still permit operation of the flashlight as a candle.

With this invention thus explained, it is apparent that numerous modifications and variations can be made without departing from the scope and spirit of this invention. It is therefore intended that this invention be limited only as indicated in the appended claims.

I claim:

1. A flashlight comprising:

a barrel body of electrically conductive material having annular front and rear end portions spaced apart from each other in an axial direction to form a battery unit accommodating space therebetween;

a sleeve member sleeved co-axially and threadedly on said front end portion of said barrel body and having an inner wall surface formed with an inwardly projecting stop unit;

a lamp unit disposed in said sleeve member, said lamp unit including a lamp seat and a light bulb mounted removably on said lamp seat;

an electrical conductor unit disposed in said sleeve member between said front end portion of said barrel body and said lamp unit, said electrical conductor unit including a conductive core member having a first end in electrical contact with said light bulb, and a second end adapted to electrically contact with a first electrode of the battery unit in the battery accommodating space, a core holding block of electrical insulating material formed with an axial core mounting hole in which said core member is mounted, and a tubular conductive coupling member having said core holding block received therein, said coupling member having a rear section in electrical contact with said front end portion of said barrel body, and a front section engaging in electrical contact with said lamp seat thereby electrically connecting said barrel body and said lamp seat;

a resilient biasing member disposed in said sleeve member and having one end limited by said stop unit and an opposite end abutting against said lamp seat, said resilient biasing member pushing said lamp seat for urging said coupling member to abut against said front end portion of said barrel body to ensure electrical contact between said coupling member and said barrel body when said sleeve member is rotated relative to said barrel body while maintaining engagement with said barrel body; and a switch device mounted operably on said rear end portion of said barrel body and adapted to be operated to make or break electrical connection between said barrel body and a second electrode of the battery unit in said battery accommodating space.

2. The flashlight as defined in claim 1, further comprising a reflector unit mounted co-axially on said sleeve member.

3. The flashlight as defined in claim 2, wherein said reflector unit includes a reflector cap sleeved threadedly on said sleeve member, a light reflector disposed in said reflector cap, and a biasing member for biasing said light reflector in the axial direction away from said sleeve member.

4. The flashlight as defined in claim 3, wherein said coupling member engages threadedly to said lamp seat.

5. The flashlight as defined in claim 1, wherein said stop unit is formed as an annular flange.

6. The flashlight as defined in claim 1, wherein said core member has an axial length greater than that of said core mounting hole.

7. The flashlight as defined in claim 1, wherein said barrel body has a roughened outer wall surface.

* * * * *